US005141776A

United States Patent [19]

Merzhanov et al.

[11] Patent Number: 5,141,776

[45] Date of Patent: Aug. 25, 1992

[54] METHOD OF DEPOSITING A REFRACTORY INORGANIC COATING ON THE SURFACE OF A WORKPIECE

[76] Inventors: Alexandr G. Merzhanov, ulitsa Tretya, 3, kv.2.; Emil A. Shtessel, ulitsa Tsentralnaya, 4"v", kv.27; Evgeny P. Kostogorov, ulitsa Pervaya,13,kv.4, all of Moskovskaya oblast, poselok Chernogolovka, U.S.S.R.

[21] Appl. No.: 613,852

[22] Filed: Dec. 6, 1990

[51] Int. Cl.[5] ..... C23C 12/00; C23C 16/00

[52] U.S. Cl. ..... 427/255.2; 427/255.1

[58] Field of Search ..... 427/250, 252, 253, 255.1, 427/255.2

[56] References Cited

U.S. PATENT DOCUMENTS

| | | | |
|---|---|---|---|
| 3,622,374 | 11/1971 | Pike | 427/252 |
| 3,862,851 | 1/1975 | Speirs et al. | 427/252 |
| 3,900,592 | 8/1975 | Kennedy | 427/39 |

FOREIGN PATENT DOCUMENTS

| | | | |
|---|---|---|---|
| 62341 | 2/1962 | U.S.S.R. . | |
| 1142525 | 2/1985 | U.S.S.R. | 427/252 |
| 1504287 | 8/1989 | U.S.S.R. | 427/252 |

OTHER PUBLICATIONS

Collected Works "Thermochemical treatment of Metals and Alloys", 1974, pp. 126–127.

"Refractory Coatings", Moscow Metallurgia, 1973, pp. 357–370.

Patent Abstracts of Japan, JA 63-050,458 Jul. 27, 1988.

*Primary Examiner*—Shrive Beck

*Assistant Examiner*—Roy V. King

*Attorney, Agent, or Firm*—Ladas & Parry

[57] ABSTRACT

The method relates to inorganic chemistry.

Pursuant to the method, a powder mixture comprising a transition metal, a nonmetal, an inert filler and an activator is prepared; a workpiece to be coated is embedded in the powder mixture and this is placed, integrally with the workpiece, into an oxygen-free medium for a subsequent heat treatment which is accomplished by a locally-initiated combustion of the powder mixture.

7 Claims, No Drawings

METHOD OF DEPOSITING A REFRACTORY INORGANIC COATING ON THE SURFACE OF A WORKPIECE

FIELD OF THE INVENTION

The present invention relates to inorganic chemistry and has specific reference to a method of depositing a refractory inorganic coating on the surface of a workpiece.

PRIOR ART

As the service conditions of modern plant equipment become increasingly complex, there is a demand for new metals and ceramics with mechanical and corrosion-resistance properties of a higher order. However, in the light of economic and ecologic factors (depletion and short supply of mineral resources, the impact of metallurgical processes on the environment) such an approach seems to be problematic. Concurrently with developing new materials, much effort is applied in seeking—as an alternative—new techniques of modifying the surface layer of known materials so as to render it more wear- and heat-resistant and more durable in aggressive media. Numerous ways of applying protective coatings to metals, alloys and ceramics are known nowadays. Standing apart among them is, e.g. plasma spray—a method of blowing a coating powder (boride, carbidem silicidem nitride) onto the surface of product across a plasma formed by a gas (G. V. Samsonov, A. P. Apik "Refractory coatings", 2nd Edition. Moscow: Metallurgiya Publishers, 1973, pp. 118–119).

The method requires sophisticated equipment and is characterized by high consumption of power, plasma-forming gas and coating powder. The powder must meet stringent requirements as to the composition, uniformity of particle size and free-flowing characteristics. A plasma-sprayed coating has a porous surface and adheres poorly to the substrate. The method is not adapted to coating the inside surface of products.

Also in use is a chemical vapor coating of various types (G. V. Samsonov, A. P. Apik "Refractory coatings", 2nd Edition. Moscow: Metallurgiya Publishers, 1974, pp. 357–370).

The source materials used in this case are various gaseous halogenides, carbonyls and organo-metallic compounds. On being decomposed or on entering into reaction with other gaseous components of the compounds, they provide for forming and depositing specified coatings on the product. The specimen to be coated is placed into a coating vessel at low pressure and exposed to the action of a stream of reactant gases at a high temperature (600°–1200° C.). The temperature improves adhesion of the coating to the substrate by bringing about diffusion. On the other hand, there is a tendency for the compounds forming the coating to decompose or get reduced at a distance from the hot substrate. Poor adhesion and chalking is the result. The starting materials must be of a high purity. Oxygen, nitrogen and water vapor, if present, impart brittleness to the coating and impair its adhesion. The process is sensitive even to slight variations in the concentration of the reactant gases, the pressure of the gas stream and its velocity. For a uniform thickness of the coating, a constant substrate temperature is indispensable throughout the process. To meet all these requirements, sophisticated equipment is required, comprising a vacuum pump, a means of intermixing and feeding the reactant gases at a controlled rate and a means for heating the workpiece. Only a limited range of coatings can be obtained in this way, for the gaseous compounds of the elements forming the coating are in short supply.

Known in the art is a method of depositing a refractory inorganic coating on the surface of a workpiece according to which a powder composition is prepared from at least one transition metal of the periodic table, an inert filler and an activator; the workpiece is embedded in the powder composition which is then placed, together with the workpiece, into an oxygen-free medium for subsequent heat treatment therein (G. N. Dubinin, M. G. Karpman, D. F. Altshuler, A. S. Viskov "Diffusion coating of vanadium to carbon and stainless steels", Collected Works "Thermochemical treatment of metals and alloys", editor L. S. Lyakhovich. Minsk, 1974, p. 126).

The method is designed to apply diffusion coating of vanadium in layers to carbon and stainless steels. The powder composition used consists of 50% by mass vanadium as the saturating element, 49% by mass aluminum oxide as the inert filler and 2% by mass ammonium chloride as the activator. The ammonium chloride reacts with the vanadium and the vanadium is transported to the surface of the workpiece due to the reaction at high temperatures only. The workpiece embedded in the powder composition is heat treated at 900°–1150° C., the heat input being effected at the outside surface of the composition. No other type of heat treatment is applicable in this case, for the powder composition is thermally neutral irrespective of the percentage of the ingredients. The treatment of the workpiece in accordance with the prior art method results in depositing a diffused vanadium layer only. The atoms of vanadium diffuse into the carbon and stainless steels under high-temperature isothermal conditions. For a given fixed amount of the activator, i.e. under a constant reactivity of the gas medium, the thickness of the vanadium coating is a function of time and the coefficient of diffusion of the vanadium in carbon and stainless steels. Taking into account that low values of diffusion coefficient are characteristic of solids, the method resorts to a period of saturation lasting as long as 3–9 hours. High power requirements are unavoidable in this case. But, in spite of the long high-temperature holding time, the prior art method is practically of no value in coating nonmetals, e.g. ceramics, for the diffusion of any coating-forming element occurs there at a very low rate. Similar difficulty is experienced when a transported metal of a high atomic number, e.g. molibdenum or tungsten, is being diffused even on a metallic substrate. Accordingly, the prior art method is restricted to a limited number of transported metals and a limited number of substrates. Since temperature gradients are practically inexistent in the thermally neutral powder compound during the lasting isothermal treatment, no coating deposited on the surface of the workpiece by the prior art method can be formed.

An introduction of more than one transported metal or some other chemical elements into the powder compound without changing the conditions of the heat treatment and the activator, results in a preferential saturation of that element the diffusion rate whereof in the substrate is at a maximum. Those ingredients of the powder compound which react with each other cannot be transported to the surface.

The inert filler $Al_2O_3$ is employed by the prior art method in order to prevent the sintering of the powder compound during the high-temperature isothermal treatment. But, if used in an amount over 48% by mass, the inert filler reduces the percentage of transported metal and that of activator in the compound and impairs the reactivity of the gaseous phase.

Apart from that, an inert filler of a composition different from that of the saturating element of the powder compound may contaminate the coating with admixtures which may have an adverse effect on the properties of the coating.

The oxygenfree medium is set up in the prior art method by expelling air from the voids of the powder compound with the activator which evaporates during the heat treatment. This technique may fail to provide adequate protection against oxidation to the ingredients of the powder compound and the surface of the workpiece which is being coated.

Finally, the lasting high-temperature treatment transforms the material of the workpiece both physically and chemically, affecting its properties (brittleness, loss of strength, tempering).

DISCLOSURE OF THE INVENTION

The principal object of the invention is to provide a method of depositing a refractory inorganic coating on the surface of a workpiece which would increase the rate of the process and the output, make the process significantly less powerintensive, and extend the range of the compositions of metals with nonmetals suitable for the deposition of refractory inorganic coatings; this being achieved by virtue of the qualitative and quantitative content of the components and a specified mode of carrying out the process of high-temperature treatment.

This object is realized by disclosing a method of depositing a refractory inorganic coating on the surface of a workpiece—pursuant whereto a powder composition is prepared which consists of at least one transition metal of the periodic table, an inert filler and an activator; the workpiece is embedded in the powder composition and this is placed together with the workpiece into an oxygen-free medium for a subsequent heat treatment—wherein, in accordance with the invention, at least one nonmetal of the periodic table capable of reacting exothermally with the transition metal is added to the powder composition in an amount which brings the aggregate content of the transition metal and nonmetal to approximately 80–94% by mass and gives rise to a stoichiometric metal-to-nonmetal ratio which is determined by the valence of the transition metal; the activator is iodine in an amount of approximately 1–5% by mass; the inert filler, in an amount which makes up the balance, is a composition of the transition metal with the nonmetal; whereby the ratio of the mass of the powder composition to that of the workpiece is between 1:0.5 and 1:1; the oxygen-free medium is argon; and the heat treatment is a locally-initiated combustion of the powder composition.

The abovementioned objects are also realized through the agency of a method of depositing a refractory inorganic coating on the surface of a workpiece—pursuant whereto a powder composition is prepared which consists of at least one transition metal of the periodic table, an inert filler and an activator; the workpiece is embedded in the powder composition and this is placed together with the workpiece into an oxygen-free medium for a subsequent heat treatment—wherein, in accordance with the invention, the transition metal amounts to 78–94% by mass of the compound; the activator is iodine in an amount of 1–5% by mass; the inert filler, in an amount which makes up the balance, is a nitride of the transition metal used; whereby the ratio of the mass of the powder composition to that of the workpiece is between 1:0.5 and 1:1, the oxygen-free medium is argon, and nitrogen gas is additionally introduced into the powder composition, the inert gas and the nitrogen gas being admitted in a single flow with a ratio of 1:10—by volume at a rate of approximately 0.01–0.02 l/mn per square centimeter of the cross-sectional area of the composition; and the heat treatment is a locally-initiated combustion of the powder composition.

The essence of the disclosed method of depositing a refractory inorganic coating is that the thermal, chemical and diffusion processes take place all at a time when the elements comprising the powder composition react with each other. The locally-initiated heat effect induces the transition metal or metals to enter into an exothermal reaction with the nonmetal or nonmetals introduced into the composition. A nucleation site of the reaction advances through the composition as a flame front at a velocity of 0.4–3 cm/s. Since the temperature of the flame front varies spatially from an initial value, which is the ambient temperature (20° C.), to the temperature of combustion (1500°–3000° C.), the iodine may turn gaseous in a zone of increase in temperature, which is termed the heating zone. At the same time, the iodine heterogenously enters into a reaction with the transition metal and nonmetals to form volatile iodides of these elements. A point to be noted is that the forward reaction yielding volatile iodides occurs at low temperatures of up to 900° C. The formed iodide complexes of the transition metal and nonmetal diffuse in the gaseous medium through the voids of the powder composition and are transported to the surface of the workpiece. Further increase in the temperature due to the advancing flame front (over 900° C.) upsets the chemical equilibrium and gives rise to reverse reactions: a reaction of thermal decomposition and that of disproportioning of the iodide compounds. The evolved transition metal and the nonmetal are deposited on the surface of the workpiece. Reacting with each other and the material of the substrate at high temperature, the deposited elements thus form the refractory inorganic coating.

The ratio of deposition, composition, thickness and quality of the coating and the changes in the phases and structure of the material of the workpiece brought about by heating are all dependent upon the temperature of combustion and the velocity at which the wave of combustion progresses. The two last-named factors vary, in their turn, with the composition of the original powder composition and the ratio of the masses of the compound used and the workpiece coated.

The considerations to be taken into account in selecting the composition of the powder and the ratio of masses are as follows. Firstly, the amount of heat generated must be greater than the aggregate heat losses from the zone of the reaction, for otherwise the process cannot rely on combustion. Secondly, the surface of the workpiece must be heated up at a high tempo in order to speed up the rate of diffusion of the deposited elements into the workpiece and improve the adhesion of the coating. Thirdly, the chemical reactions of transport, i.e. those of forming and decomposition of the iodides of the transition metal and nonmetal and those of transport of the elements to the surface due to diffusion, must come to an end in good time. Finally, care must be exercised that no changes in the phases and structure of the core of the material of the workpiece are brought about by the high temperature during a not too long period of heat treatment.

The nonmetal reacting exothermally with the transition metal, which is additionally introduced into the powder composition, provides for conducting the process by combustion. The fact that the ratio between the metal and nonmetal is a stoichiometric one and is determined by the valency of the transition metal ensures a maximum possible liberation of heat. Any deviation from the stoichiometric ratio due to a surplus content of either the transition metal or nonmetal leads to an incomplete conversion of the superfluous component and contamination of the coating with the unreacted remnants thereof.

The aggregate content of the transition netal and nonmetal is 80–94% by mass. A content less than 80% by mass cancels out the possibility of self-contained combustion brought about by local initiation, because the concentration limit of dilution is exceeded in this case. A stoichiometric mixture of the transition metal and nonmetal which exceeds 94% by mass increases the rate and temperature of combustion so that the transport reactions do not end due to time shortage, the powder composition gets sintered and the surface of the workpiece fuses.

A transition metal content of the powder compound is opted for at 78–94% by mass in order to enable the reaction of combustion of the transition metal with the nitrogen to proceed at a rate which provides for the concurrent chemical reactions of transport to take effect. A transition metal content less than 78% by mass makes a layerwise combustion impossible, for the aggregate heat liberation is low. A transition metal content over 94% by mass promotes the spreading of the flame front over the powder composition but the characteristic time of combustion is less than the characteristic time needed for the chemical reactions of transport to come to an end. No coating composed of a nitride of metal can form in this case.

A flow rate of the argon and nitrogen gas between 0.01 and 0.02 l/mn is sufficient for the transition metal and nitrogen to combine in stoichiometric relationship. Also a layerwise combustion takes place if a flow rate of the nitrogen and argon is used within the above range for a given composition of the powder composition. At a flow rate less than 0.01 l/mn, a meager supply of the nonmetal, i.e. nitrogen gas, limits the amount of heat liberated, and the frontal progress of the process is impossible. A flow rate over 0.02 l/mn brings about a sharp increase in temperature, leading to fusion and sticking of the powder composition to the surface of the workpiece.

Iodine, if used as the activator, extends the range of deposited coatings. It turns gaseous in the heating zone of the flame front, readily reacts with all transition metals and most of the nonmetals and forms gaseous complexes at the combustion temperature which are turned into the coating by the reactions of decomposition. The iodine also stabilizes the combustion. The specified content of the iodine is 1–5% by mass in the powder composition. A content less than 1% by mass, destabilizes the combustion, limits the thickness of the coating to less than 5 μm and cannot prevent discontinuities therein. A content over 5% by mass leads to an oversaturation of the iodides at the temperature of combustion. Elements of the gaseous phase condense at a distance from the workpiece so that chalking and poor adhesion and unavoidable.

The inert filler in the form of a compound of the transition metal with the nonmetal introduced into the powder composition in an amount which makes up the balance serves to control the temperature and the rate of advance of the combustion. Fouling of the coating is prevented, because the composition of the mixture of the transition metal with the nonmetal is identical with the composition of the coating.

The nitride of the transition metal, which is inert with respect to the components of the powder composition, is also added for controlling the temperature and rate of combustion. No fouling of the coating with admixtures is observed in this case. A ratio of the mass of the powder composition to that of the workpiece which is between 1:0.5 and 1:1 guarantees stable combustion of the powder composition and control of the maximum temperature of combustion.

A higher ratio of the masses increases the heat which the chemically reactive compound keeps in stock so much that unwanted changes in the phases and structure of the material of the workpiece (melting and resolidification of metals, fracturing and failure of ceramics) are brought about even if the content of the inert filler is at a maximum compatible with a stable combustion. A ratio of the masses which is less than the specified value results in an inadequate heating up even of the surface layers of the workpiece and poor adhesion of the coating. An abstraction of heat into the workpiece and the surrounding powder composition gives rise to high heat losses which make the combustion impossible for accomplishing the method. A ratio of the masses of the powder composition and workpiece which is between 1:0.5 and 1:1 provides for a maximum temperature of the workpiece of 550°–800° C. on the average. The temperature of the workpiece can be as high as that of combustion at the surface and quite low at the center, depending on the characteristic linear dimension of the workpiece and physical properties of its material.

However, no marked changes in the phases and structure of the material of the workpiece take place, because of the heating by combustion being a transient process (cooling sets in immediately after the flame front has passed).

The argon which is employed in the capacity of the oxygenfree medium forestalls high-temperature oxidation of the powder composition and the workpiece embedded therein and provides for conducting the method under a pressure of the environment without resorting to air-tight equipment. The argon prevents neither the combustion nor the chemical reactions of transport from taking effect. Being inert, it is not a source of unwanted admixtures. The used mixture of nitrogen and argon in a ratio of 1:10 by volume gives reliable protection to the composition and workpiece against oxidation on the one hand and has no adverse effect on the process of combustion on the other hand.

The local initiation of the combustion by applying a heat pulse to the exothermal composition within a limited surface area thereof is the only way of triggering a layerwise combustion. Any other type of initiation gives rise to a spatial reaction, i.e. brings about thermal explosion, which precludes the deposition of coating from the powder composition of the disclosed composition, provided the disclosed ratio of the masses of the compound and workpiece is used.

It is preferred to use boron as the nonmetal and the boride of the transition metal as the compound of the transition metal with the nonmetal.

The boron, on being added, reacts with the transition metal and iodine to form a hard coating consisting of the boride of the transition metal. Having a low atomic number, the boron displays a high rate of diffusion in metals and alloys so that wide diffusion zones (up to 10–50 μm) are formed which provide for good adhesion of the coating. The boride of the metal, added to the powder composition as the product of a reaction between the originally introduced transition metal and boron, is inert relative to the reactive components of the composition and serves to control the combustion temperature. Being of a composition which is identical with that of the deposited coating, the boride of the transition metal does not foul the coating.

It is also preferred to employ titanium as the transition metal and use boron in a stoichiometric ratio of 2:1 with the titanium and to employ titanium diboride as the boride of the transition metal.

Titanium powder, if used in conjunction with boron, yields a wear-resistant coating in titanium diboride. The stoichiometric ratio between the boron and titanium provides for depositing a single-phase coating with a maximum utilization of the heat energy of the compound. The substitution of the titanium diboride for the boride of the transition metal prevents fouling of the coating with unwanted admixtures.

It is further preferred to employ silicon as the nonmetal and the silicide of the transition metal used as the compound of this metal with the nonmetal.

The silicon, on being added to the powder composition, reacts with the transition metal and iodine so that a heat-resistant silicide coating is formed. Being inert relative to the starting reactive components of the powder composition—the transition metal and boron—the silicide of the transition metal offers an opportunity to control the temperature and rate of combustion. Apart from that, the coating so formed is not fouled by unwanted admixtures.

It is possible to use molybdenum as the transition metal and to add the silicon in a stoichiometric ratio of 2:1 relative to the molybdenum and to employ molybdenum disilicide as the silicide of the transition metal.

Molybdenum powder, if used in conjunction with silicon, yields a wear- and oxidation-resistant coating in molybdenum disilicide. The stoichiometric ratio between the silicon and molybdenum provides for depositing a single-phase molybdenum disilicide coating with a maximum utilization of the heat energy of the compound. The substitution of the molybdenum disilicide for the silicide of the transition metal does not introduce additional admixtures into the coating and keeps it clean.

It is also possible to use zirconium as the transition metal and zirconium nitride as the nitride of the transition metal. The zirconium provides for depositing a single-phase zirconium nitride coating which does not jam at elevated temperatures.

The zirconium nitride used as the nitride of the transition metal has a composition identical with that of the coating and does not foul it with unwanted admixtures introduced into the powder composition.

PREFERRED EMBODIMENT OF THE INVENTION

The disclosed method operates as follows.

A powder composition containing at least one transition metal of the periodic table, an inert filler and an activator is prepared. At least one nonmetal of the periodic table capable of reacting exothermally in particulate state with the transition metal is added to the composition in an amount which brings the aggregate content of the transition metal and nonmetal up to 80–94% by mass, whereby the transition metal and nonmetal are present in a stoichiometric ratio determined by the valence of the transition metal. The above aggregate content of the transition metal and nonmetal enables these elements to react with each other so as to set up a self-propagating combustion front. An aggregate content less than 80% by mass terminates the reaction, a limit of combustion being reached due to heat losses. The heat liberated during the reaction of combustion is insufficient for the combustion front to propagate on its own accord. An aggregate content of the transition metal and nonmetal in particulate form which exceeds 94% by mass induces, on the other hand, a combustion with an abundant liberation of heat so that the process temperature exceeds the melting points of the source materials, products of reaction and workpiece. The stoichiometric ratio between the transition metal and nonmetal works for the reaction of combustion to come to its full end. A deviation from the stoichiometric ratio creates a surplus of one of the components which acts then as an inert diluent. Absorbing heat, this component makes the propagation of the flame front impossible.

Boron, if used as the nonmetallic component of the powder composition, readily reacts with the transition metals. The liberated heat is sufficient to sustain combustion.

Silicon powder, which can also be used as the nonmetallic ingredient of the composition, provides for generating much heat energy as well. The coating in silicides of metals, which is deposited in this case, is highly heat resistant in oxidizing media.

Activator, another indispensable ingredient of the powder composition, is crystalline iodine added in an amount of 1–5% by mass.

Iodine owes its utility to its multifaceted transporting ability. Turning gaseous readily and in full under the conditions of the propagating combustion front, iodine reacts with all transition metals and most of the nonmetals—boron and silicon included—to form volatile compounds. When the combustion temperature reaches a maximum, the transition metals and nonmetals are heterogeneously deposited on the surface of the workpiece from the volatile compounds due to the reactions of disproportioning, thermal decomposition and exchange with the material of the substrate. Stabilization of the main reaction of combustion which brings about a uniform advance of the combustion front is another function of the iodine.

These factors decide the iodine content of the powder composition. A content less than 1% by mass, results in an irregular propagation of the combustion front. The coating acquires consequently a nonuniform thickness, being too thin and showing discontinuities. A content in excess of 5% by mass leads to an oversaturation of the gaseous phase and, as a result, to chalking and poor adhesion of the coating.

The inert filler, which is the last ingredient added to the composition, is a combination of the used transition metal with a nonmetal. It is introduced in an amount which makes up the balance, varying between 1 and 19% by mass. The combination of the used transition metal and nonmetal is inert as regards the reactive ingredient of the powder composition and takes no part in the process of exothermal transformation. It takes part, as the inert filler, only in absorbing some heat of the exothermal reaction so as to keep the temperature and rate of combustion within the prescribed limits. Used as the nonmetal is boron or silicon. The compounds of the used transition metal with the nonmetal are borides and silicides of the respective transported metals. The borides and silicides used do not foul the coating with unwanted admixtures.

If a coating with a high hardness and wear-resistance is specified, the transition metal is titanium powder and the nonmetal is boron powder in an amount decided by the stoichiometric ratio of 2:1 relative to the titanium. Titanium diboride is the compound of the used transition metal with the boron in this case.

If a coating with a high heat-resistance in oxidizing media is specified, the transition metal is molybdenum powder and the nonmetal is silicon powder taken in an amount decided by the stoichiometric ratio of 2:1 relative to the molybdenum. Molybdenum disilicide is the compound of the used transition metal with the silicon.

The source of the exothermal compound are powders of the transition metals, nonmetals, inert filler and activator with the particles varying in size over a range as wide as 3 to 150 μm. The components are thoroughly intermixed, all at a time.

The process is confined to a vertical tubular reactor of an arbitrary cross-sectional area which is decided, together with the height, by the dimensions of the workpiece. The material of the reactor is stainless steel of any kind. A porous gridwork (grog, porous ceramics, coarse sand, etc.) is provided at the bottom of the reactor to give support to the prepared powder composition which is charged into the reactor. The workpiece is totally embedded in the composition with a clearance of at least 1 cm from the reactor walls. The ratio of the mass of the composition to that of the workpiece is between 1:0.5 and 1:1. A failure to observe a recommended ratio may either make the combustion impossible because of high losses or, on the other hand, may lead to evolving so much heat that unwanted changes in the phases and structure of the powder composition and workpiece take place.

On charging the reactor, argon is pressure-fed through the porous gridwork to create the oxygenfree atmosphere therein. The argon, the molecular mass whereof is greater than that of air, provides a reliable protection against oxidation to the contents of the reactor.

The heat treatment is combustion which is locally initiated, e.g., with a tungsten coil electrically heated to 2200°-2500° C. The initiation continues until stable combustion is obtained and lasts not over 3-5 s irrespective of the possible content of the composition. As the combustion front starts progressing inside the charge, a continuous stream of gaseous iodine issues from an open top end face of the reactor. The gas is condensed and the iodine recycled into the process in appropriate equipment additionally provided to that end.

When the gas evolvement comes to an end, this is an indication that the process of combustion is over. The reactor is cooled on its own accord or by a cooling system to room temperature, the argon feed is cut off and the reactor contents are unloaded.

In another embodiment of the invention, the method consists in preparing a powder composition from at least one transition metal of the periodic table, an inert filler and an activator, whereby the metal amounts to 78-94% by mass. The metal is a source material of the coating and also a source of the heat energy which is required in order to carry out heat treatment during an exothermic reaction with a nonmetal. The above limits of metal content provide for conducting combustion in the form of a flame front progressing layerwise. A content less than 78% by mass brings the reaction to an end, because a combustion limit is reached due to heat losses. A content in excess of 94% by mass stimulates an evolvement of so much heat during the combustion that the powder composition and workpiece can melt.

A second ingredient of the powder composition is the activator which is crystalline iodine taken in an amount of 1-5% by mass. Iodine owes its utility to its multifaceted transporting ability. Turning readily gaseous, the iodine reacts with the transition metal to form volatile compounds under the conditions of the propagating combustion front. The volatiles diffuse through the gaseous phase on the surface of the workpiece and form there a layer of the transition metal on being decomposed due to a further increase in the temperature.

An iodine content which is less than 1% by mass leads to the deposition of a thin discontinuous coating. A content in excess of 5% by mass increases the concentration of the iodines in the gaseous phase to a point when chalking and poor adhesion of the coating are inevitable.

Finally introduced into the powder composition is the inert filler which is a nitride of the used transition metal taken in an amount of 1-21% by mass. Without entering into reaction with the reactive components of the compound, the nitride of the transported metal absorbs the heat of the exothermal reaction of combustion.

To produce a coating which does not jam at elevated temperatures, zirconium is used as the transition metal in powder form and zirconium nitride is employed as the nitride of the transition metal.

The source materials of the exothermal compound are powders of the transition metal, the inert filler and the activator with a particle size varying between 3 and 150 μm. The ingredients are thoroughly intermixed, all at a time.

The process is confined to a vertical tubular reactor of an arbitrary cross-sectional area which is decided, and so is the height, by the dimensions of the workpiece. The material of the reactor is stainless steel of any kind. A porous gridwork is provided at the bottom of the reactor to give support to the prepared powder composition which is charged into the reactor. The workpiece is totally embedded into the composition with a clearance of at least 1 cm from the reactor walls. The ratio of the mass of the composition to that of the workpiece is taken between 1:0.5 and 1:1. A failure to observe a recommended ratio may either make the combustion impossible because of high heat losses or, on the other hand, may lead to evolving heat in a large amount bringing about unwanted changes in the phases and structure of the powder composition and workpiece.

On charging the reactor, a 1:10 mixture of argon and nitrogen gas is fed into the powder composition through the porous gridwork at a rate of 0.01–0.02 l/mn per square centimeter of the cross-sectional area of the composition. The argon gives the powder composition and workpiece protection against oxidation by the oxygen of the atmosphere. The argon-to-nitrogen ratio of 1:10 furnishes not only reliable protection against oxidation but does not interfer with the combustion and the reactions of transport which take place. The disclosed rate of gas flow provides for depositing a nitride coating on the surface of the workpiece, whereby the stoichiometry of the coating is decided by the valence of the transition metal.

The heat treatment is combustion locally initiated, e.g., with a tungsten coil electrically heated to 2200°–2500° C. The initiation lasts until stable combustion is obtained and never exceeds 3–5 s for any transition metal of the periodic table. As the combustion starts progressing inside the charge, a continuous stream of gaseous iodine issues from an open top end face of the reactor. The gas is condensed and the iodine is recycled into the process in appropriate equipment.

The process comes to an end when the combustion front reaches the lower end face of the reactor. The reactor is cooled to room temperature, the flow of argon and nitrogen gas is discontinued, and the reactor is unloaded.

Below are given examples illustrating a way in which the disclosed method is realized.

piece was 50 g, and the ratio of the mass of the composition to that of the workpiece was 1:0.5.

On loading the reactor, argon was admitted thereinto for 30 s through a lower connection in a controlled flow so as to set up an inert atmosphere without carry-over of the powder. Combustion of the composition was initiated through an open upper end face of the reactor, using a coil supplied with a 3 A current at 30 V. The period of initiation was 3–5 s.

The surface temperature of the workpiece was 1000°±50° C., and the average temperature of the workpiece was 810°±50° C. The temperature measurements were taken automatically with a tungsten-rhenium thermocouple and potentiometer.

When the combustion was over, the reactor was cooled by admitting cold water into the reactor jacket, and the finished workpiece was dumped therefrom. An X-ray phase analysis proved that a TiSi phase with a thickness of 5–9 μm—as determined from a microsection—was deposited at the surface.

The total duration of the process which was 10 mn was broken down as follows: charging the reactor and blowing through, 1 mn; initiation of combustion and combustion itself, 30 s; cooling, the balance. The power requirement was $10^{-3}$ kW·h.

The results of Examples 2 through 6 are tabulated in Tables 1 and 2. The sequence of events in conducting these Examples was the same as in Example 1.

TABLE 1

| | | Composition of original compound | | | | | | |
|---|---|---|---|---|---|---|---|---|
| | | Mixture Me + Si | | Stoichiometric | Silicide of metal | | Iodine | |
| Example 1 | Metal used 2 | % by mass 3 | weight, g 4 | ratio Me:Si 5 | % by mass 6 | weight, g 7 | % by mass 8 | weight, g 9 |
| 2 | Ta | 88 | 73.3 | 1:2 | 10 | 8.3 | 2 | 1.7 |
| 3 | Nb | 90 | 142.3 | 1:2 | 7 | 11.1 | 3 | 4.6 |

| | Particulars of workpiece | | | Compound-to-workpiece mass ratio | Process variables | | |
|---|---|---|---|---|---|---|---|
| Example 1 | Name, material 10 | Dimensions mm 11 | weight, g pieces 12 | 13 | Duration of process mn 14 | Average workpiece temperature, °C. 15 | Thickness of coating, μm 16 |
| 2 | Plate, tantalum | 50 × 10 × 5 | 41.6 2 | 1:0.66 | 8 | 820 | 10–14 |
| 3 | Casing mould, ceramics | D = 20 d = 10 h = 70 | 158 1 | 1:1 | 10 | 1030 | 15–19 |

Notation:
D — outside diameter of workpiece;
d — inside diameter of workpiece;
h — height of workpiece.

EXAMPLE 1

A 100-g charge of powder composition containing 94% by mass (94 g) powder titanium and silicon taken in a stoichiometric ratio of 1:2 (Ti, 43,3 g; Si, 50.7 g), 3% by mass (3 g) titanium disilicide, 1% by mass (1 g) crystalline iodine in powdered form was prepared. The particle size of the ingredients was 100–120 μm for the powders of titanium and titanium disilicide, 30–60 μm for silicon and 5–15 μm for the powder of crystalline iodine. The ingredients were thoroughly intermixed to obtain a homogenous composition.

In a vertical tubular reactor with a diameter of 50 mm, some of the composition was placed so as to form a layer at least 5 mm high on the porous gridwork. A workpiece which was a 40 by 40 by 20 mm graphite plate was placed on the bed of the composition and fully covered with the rest thereof. The weight of the work-

EXAMPLE 7

A 45-g charge of powder composition was prepared comprising 93% by mass (42 g) powder titanium with a particle size of 0.125–0.15 mm, 5% by mass (2 g) powder titanium nitride of the same particle size, 2% by mass (1 g) crystalline iodine ground to a particle size of 0.005–0.003 mm.

The composition was placed on a porous gridwork (grog, porous ceramics, stainless steel wire gauze) at the bottom of a circulating tubular reactor with a diameter of 40 mm, and the workpiece was embedded in the composition. The workpiece was a milling cutter consisting of a structural steel shank, with a diameter of 25 mm and 50 mm long; to an end face whereof there were brazed four rapid steel blades measuring 7×4×2 mm. The melting point of the brazing alloy was 935° C. The weight of the embedded part of the cutter was 45 g. The ratio of the masses of the compound and workpiece was 1:1. The blades were specified to be coated without disturbing the integrity of their joint to the shank.

TABLE 2

| | | Composition of original compound | | | | | | |
|---|---|---|---|---|---|---|---|---|
| | | Mixture Me + B | | Stoichiometric | Silicide of metal | | Iodine | |
| Example 1 | Metal used 2 | % by mass 3 | weight, g 4 | ratio Me:B 5 | % by mass 6 | weight, g 7 | % by mass 8 | weight, g 9 |
| 4 | Ti | 94 | 112.8 | 1:2 | 5 | 6 | 1 | 1.2 |
| 5 | Cr | 80 | 129.6 | 1:2 | 15 | 24.3 | 5 | 8.1 |
| 6 | Mo | 83 | 58.1 | 1:2 | 15 | 10.5 | 2 | 1.4 |

| | Particulars of workpiece | | | Compound-to-workpiece mass ratio | Process variables | | |
|---|---|---|---|---|---|---|---|
| Example 1 | Name, material 10 | Dimensions mm 11 | weight, g pieces 12 | 13 | Duration of process mn 14 | Average workpiece temperature, °C. 15 | Thickness of coating, μm 16 |
| 4 | Pump bushing, hard alloy | D = 25<br>h = 40 | 120<br>1 | 1:1 | 9 | 620 | 8–10 |
| 5 | Tube, steel | D = 12<br>h = 50 | 36<br>3 | 1:0.66 | 8 | 940 | 24–38 |
| 6 | Evaporation crucible, molybdenum | D = 35<br>h = 0.8 | 7<br>5 | 1:0.5 | 5 | 1020 | 13–15 |

Notation:
D — outside diameter of workpiece;
h — height of workpiece

On charging the reactor, a 1:10 mixture of argon with nitrogen gas was admitted thereinto through the gridwork at a rate of 0.19 or 0.015 l/mn per square centimeter of the cross-sectional area of the reactor.

The composition was ignitied at an open upper end face of the reactor with a coil in tungsten wire with a diameter of 0.5 mm and 15–20 cm long which was supplied with a 3 A a-c current at 30 V from a laboratory-type auto-transformer. The ignition period was 3 s.

The average temperature, during the layerwise progressing combustion, amounted to 520° C. The measurements were taken with a tungsten-rhenium thermocouple and automatically recorded with a potentiometer.

When the combustion came to an end, the flow of argon and nitrogen was cut off and the compound was dumped from the reactor together with the workpiece. The workpiece was coated with a titanium nitride coating the thickness whereof was 8–10 μm. The integrity of the brazed joint was not disturbed.

The process lasted 5 mn, breaking down by stages as follows: charging the reactor, 1 mn; initiation of combustion and combustion itself, 15 s; cooling, the balance. The power requirement was $8.34 \cdot 10^{-4}$ kW·h, and the nitrogen consumption was 0.2–0.4 l per cycle.

The results of Examples 8 through 11, which characterize the process, are tabulated in Table 3. The sequence of events in these Examples was the same as in Example 7.

The disclosed method creates a prospect of depositing a wide range of coatings (borides, silicides and nitrides of transition metals) for use in various applications (wear-, corrosion- and heat-resistance) in liquid and gaseous aggressive media at elevated temperatures.

A recourse to the disclosed method renders redundant various high-temperature heating appliances, saves shop floor area, reduces power requirements and simplifies the technique of depositing coatings.

TABLE 3

| | | Composition of original compound | | | | | | Workpiece particulars | | |
|---|---|---|---|---|---|---|---|---|---|---|
| | | Transition metal | | Nitride of metal | | Iodine | | | | |
| Example 1 | Metal used 2 | % by mass 3 | weight, g 4 | % by mass 5 | weight, g 6 | % by mass 7 | weight, g 8 | Name, material 9 | Dimensions, mm 10 | Weight, g 11 |
| 8 | Zr | 78 | 84 | 17 | 30 | 5 | 6 | gas turbine nozzle, hard alloy | D = 40<br>d = 25<br>h = 40 | 60 |
| 9 | Hf | 88 | 53 | 10 | 6 | 2 | 1 | Mould, ceramics | d = 40<br>h = 10 | 30 |
| 10 | V | 85 | 173 | 14 | 25.2 | 1 | 1.8 | Body with opening, hard alloy | D = 27<br>d = 10<br>h = 30 | 180 |
| 11 | Ti | 94 | 188 | 5 | 10 | 1 | 2 | Inserted blade milling cutter, hard alloy | D = 45 | 120 |

| | | | Process variables | | |
|---|---|---|---|---|---|
| Exam- | Compound-to-workpiece | Nitrogen consumption | Duration of process, | Average workpiece temperature, | Thickness of coating, |

TABLE 3-continued

| ple 1 | mass ratio 12 | l/mn 13 | mn 14 | °C. 15 | μm 16 |
|---|---|---|---|---|---|
| 8 | 1:0.5 | 0.02 | 6 | 770 | 9-11 |
| 9 | 1:0.5 | 0.01 | 7 | 860 | 15-17 |
| 10 | 1:1 | 0.015 | 16 | 820 | 8-12 |
| 11 | 1:0.6 | 0.02 | 14 | 760 | 10-12 |

Notation:
D — outside diameter of workpiece;
d — inside diameter of workpiece;
h — height of workpiece

INDUSTRIAL APPLICABILITY

The invention holds out special promise in the chemical inductry if applied for the protection of materials against high-temperature corrosion due to liquids and gases or in machine-shop practices for imparting extra hardness, wear resistance and cutting power to tools.

It may be of utility in the automotive, aircraft, shipbuilding and petroleum industries as a means of increasing the surface strength of parts exposed to dry friction and cyclic shock loads.

Not excluded is the possiblity of employing the invention in the pharmaceutical and food industries for imparting corrosion-inhibiting and germicidal properties to surfaces in contact with food products and drugs.

Finally, the invention may find application in the manufacture of building materials, giving them protection against the corrosive and erosive effect of the atmosphere or improving the appearance of surfaces by coloring them entirely or fragmentarily in a variety of finishes.

What is claimed is:

1. In a method of depositing a refractory inorganic coating on the surface of a workpiece wherein a powder composition is prepared which comprises at least one transition metal, an inert filler and an activator, the workpiece is embedded in the powder composition and the powder composition is placed integrally with the workpiece into an oxygen-free medium, whereupon heat treatment is carried out in the oxygen-free medium, the improvement comprising including in said powder composition at least one nonmetal capable of reacting with the transition metal in an exothermic reaction to form a transition metal-nonmetal compound composed of said metal and said nonmetal, the metal and the nonmetal being present in said powder composition in an aggregate amount of approximately 80-94% by mass and in a stoichiometric ratio whereby to enable a substantially complete reaction of the metal and nonmetal, the activator being iodine present in an amount of approximately 1-5% by mass of the powder composition, and the inert filler being a compound formed from the transition metal with the nonmetal and being present in an amount which makes up the balance of said powder composition, the ratio of the mass of the powder composition to that of the workpiece being approximately between 1:0.5 and 1:1; the oxygen-free medium being argon, and the heat treatment being locally initiated combustion of the powder composition which induces an exothermic reaction between said metal and said nonmetal whereby to form said transition metal-nonmetal compound on the surface of the workpiece, said transition metal-nonmetal compound constituting said refractory inorganic coating.

2. In a method of depositing a refractory inorganic coating on the surface of a workpiece wherein a powder composition is prepared which comprises at least one transition metal, an activator and an inert filler; the workpiece is embedded in the powder composition and the powder composition is placed integrally with the workpiece in an oxygen-free medium wherein a heat treatment is carried out, the improvement comprising including the transition metal in said powder composition in an amount of approximately 78-94% by mass, with the activator being iodine present in an amount of approximetaly 1-5% by mass of the powder composition, and the inert filler being a nitride of the transition metal and being present in an amount making up the balance of the powder composition; the mass of the powder composition to that of the workpiece being approximately between 1:0.5 and 1:1, and the oxygen-free medium being argon, said improvement also comprising introducing nitrogen gas into the powder composition, the argon and the nitrogen gas being fed in a single flow with a ratio of 1:10 by volume and at a rate of approximately 0.01-0.02 l/mn per square centimeter of the cross-sectional area of the powder composition, the heat treatment being locally-initiated combustion of the powder composition which induces the formation on the workpiece of a compound composed of said transition metal and nitrogen, said compound constituting said refractory inorganic coating.

3. A method as claimed in claim 1, wherein boron is employed as the nonmetal and the inert filler comprises a boride of the transition metal.

4. A method as claimed in claim 1, wherein titanium is the transition metal, boron is the nonmetal, the boron is present in a stoichiometric ratio of 2:1 with the titanium, and the inert filler comprises titanium diboride.

5. A method as claimed in claim 1, wherein silicon is employed as the nonmetal and the inert filler comprises a silicide of the transition metal.

6. A method as claimed in claim 1, wherein molybdenum is the transition metal, silicon is the nonmetal, the silicon is present in a stoichiometric ratio of 2:1 with said molybdenum, and the inert filler comprises molybdenum disilicide.

7. A method as claimed in claim 2, wherein zirconium is the transition metal and the inert filler comprises zirconium nitride.

* * * * *